US011476627B2

(12) United States Patent
Pan

(10) Patent No.: US 11,476,627 B2
(45) Date of Patent: Oct. 18, 2022

(54) ROTATABLE POWER PLUG ASSEMBLY AND POWER DEVICE HAVING THE SAME

(71) Applicant: Channel Well Technology Co., Ltd., Taoyuan (TW)

(72) Inventor: Yi-An Pan, Taoyuan (TW)

(73) Assignee: CHANNEL WELL TECHNOLOGY CO. LTD., Taoyuan (TW)

( * ) Notice: Subject to any disclaimer, the term of this patent is extended or adjusted under 35 U.S.C. 154(b) by 0 days.

(21) Appl. No.: 17/388,092

(22) Filed: Jul. 29, 2021

(65) Prior Publication Data

US 2022/0285900 A1 Sep. 8, 2022

(30) Foreign Application Priority Data

Mar. 3, 2021 (TW) ..... 110107440

(51) Int. Cl.
*H01R 35/04* (2006.01)
*H01R 27/00* (2006.01)

(52) U.S. Cl.
CPC ..... *H01R 35/04* (2013.01); *H01R 27/00* (2013.01)

(58) Field of Classification Search
CPC ..... H01R 35/04; H01R 27/00; H01R 29/00; H01R 39/64
See application file for complete search history.

(56) References Cited

U.S. PATENT DOCUMENTS 5,399,093 A * 3/1995 Schneider ..... H01R 24/28 439/21
7,946,868 B1 * 5/2011 Chen ..... H01R 35/04 439/518
8,469,730 B2 * 6/2013 Garb ..... H01R 31/065 439/166
2012/0178305 A1 * 7/2012 Chen ..... H01R 35/04 439/660

* cited by examiner

*Primary Examiner* — Travis S Chambers

(57) ABSTRACT

A rotatable power plug assembly is disclosed, which comprises: a first connection module, a second connection module and a plug module, wherein the second connection module is connected between the first connection module and the plug module. According to the present invention, the first connection module comprises a first base that is disposed on a housing of the power device, and there are two first conductive pins and two second conductive pins provided on the first base. Moreover, the plug module comprises two prongs and two electrical units electrically connected to the prongs. The two electrical units contact with the first conductive pins and two second conductive pins through the second connection module. By such arrangement, the rotatable power plug assembly according to the present invention has multiple advantages, including: comprising elements and units can be simply assembled, modular design, high durability, and high security.

15 Claims, 9 Drawing Sheets

ROTATABLE POWER PLUG ASSEMBLY AND POWER DEVICE HAVING THE SAME

BACKGROUND OF THE INVENTION

1. Field of the Invention

The present invention relates to the technology field of power supply devices, and more particularly to a rotatable power plug assembly.

2. Description of the Prior Art

When using a power supply device or an electronic device, the most frequently encountered problem for a user is that the device's power plug is not allowed to be inserted into a plug socket (i.e., power outlet) that is disposed on a wall or an power extension device. In such case, solution for the user is to purchase additional plug bridge for being connected between the plug socket and the device's power plug, such that the device's power plug is able to receive electricity from the plug socket. In other case, for multiple plug sockets that are disposed on a wall or belong to a power extension device, any two of the multi plug sockets have a constant spacing, and the constant spacings allows the insertions of small-sized plugs without having the plugs interfering with one another. However, when a plug socket A is inserted by a power plug A having a relatively larger volume (an adaptor plug for instance), the power plug A frequently blocks the insertion holes of a plug socket B that is adjacent to the plug socket A, thereby causing that the plug socket B becomes idle and cannot be used.

For solving the above-mentioned problems, rotatable electrical plug connector is therefore developed and proposed. For example, U.S. Pat. No. 5,399,093 provides a rotatable electrical plug, in which a rotative connection is provided between the power cord and the prongs, so that the housing can be biased subject to the position change of the electric appliance after connection of the electrical plug to an electrical socket. According to these designs, a rotative coupling device with concentrically arranged annular contacts provides the rotative connection between the power cord and the prongs. The main drawback of these designs is the complicated connection structure between the power cord and the rotative coupling device.

From above descriptions, it is understood that there are still rooms for improvement in the conventional the conventional rotatable electrical plug. In view of that, inventors of the present application have made great efforts to make inventive research and eventually provided a rotatable power plug assembly.

SUMMARY OF THE INVENTION

The primary objective of the present invention is to disclose a rotatable power plug assembly for use in a power (supply) device. The rotatable power plug assembly comprises: a first connection module, a second connection module and a plug module, wherein the second connection module is connected between the first connection module and the plug module. According to the present invention, the first connection module comprises a first base that is disposed on a housing of the power device, and there are two first conductive pins and two second conductive pins provided on the first base. Moreover, the plug module comprises two prongs and two electrical units electrically connected to the prongs. The two electrical units contact with the first conductive pins and two second conductive pins through the second connection module. By such arrangement, the rotatable power plug assembly according to the present invention has multiple advantages, including: comprising elements and units can be simply assembled, modular design, high durability, and high security.

In order to achieve the primary objective of the present invention, inventors of the present invention provides an embodiment of the rotatable power plug assembly, which is applied in a power device, and comprises:

a first connection module, being disposed on a housing of the power device, and comprising a first base that is provided with two first conductive pins and two second conductive pins thereon;

a second connection module, being stacked on the first connection module, and comprising a second base that is provided with four first arc-shaped guide grooves and four second arc-shaped guide grooves thereon, such that one of the two first conductive pins and one of the two second conductive pins are respectively disposed in two of the four first arc-shaped guide grooves, and the other one first conductive pin and the other one second conductive pin are respectively disposed in two of the four second arc-shaped guide grooves; and a plug module, being stacked on the second connection module, and comprising:

a substrate;

a first electrical unit, comprising a first electrical member that is disposed on a bottom surface of the substrate and a first prong that is connected to the first electrical member by a base end thereof, wherein the first electrical member is provided with two first contact points thereon, and an electrical end of the first electrical member is protruded out of a top surface of the substrate; and a second electrical unit, comprising a second electrical member that is disposed on the bottom surface of the substrate and a second prong that is connected to the second electrical member by a base end thereof, wherein the second electrical member is also provided with two second contact points thereon, and an electrical end of the second electrical member is protruded out of the top surface of the substrate;

wherein in case of the second connection module being rotated to have a rotation angle that is equal to a predetermined angle, one of the two first conductive pins contacting with one of the two first contact points of the first electrical member, and one of the two second conductive pins contacting with one of the two second contact points of the second electrical member;

wherein in case of the second connection module being rotated to have the rotation angle that is equal to zero degree, the two first conductive pins contacting with the two first contact points of the first electrical member, and the two second conductive pins contacting with the two second contact points of the second electrical member.

The present invention also discloses a power device for supplying power to an electronic device, characterized in that having the forgoing rotatable power plug assembly according to the present invention. In practicable embodiments, the power device can be a charging device, power conversion device, power adapter, power extension device, and power bank.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a rotatable power plug assembly and a power device having the forgoing rotatable power plug that are disclosed by the present invention, embodiments of the present invention will be described in detail with reference to the attached drawings hereinafter.

Figure 1:
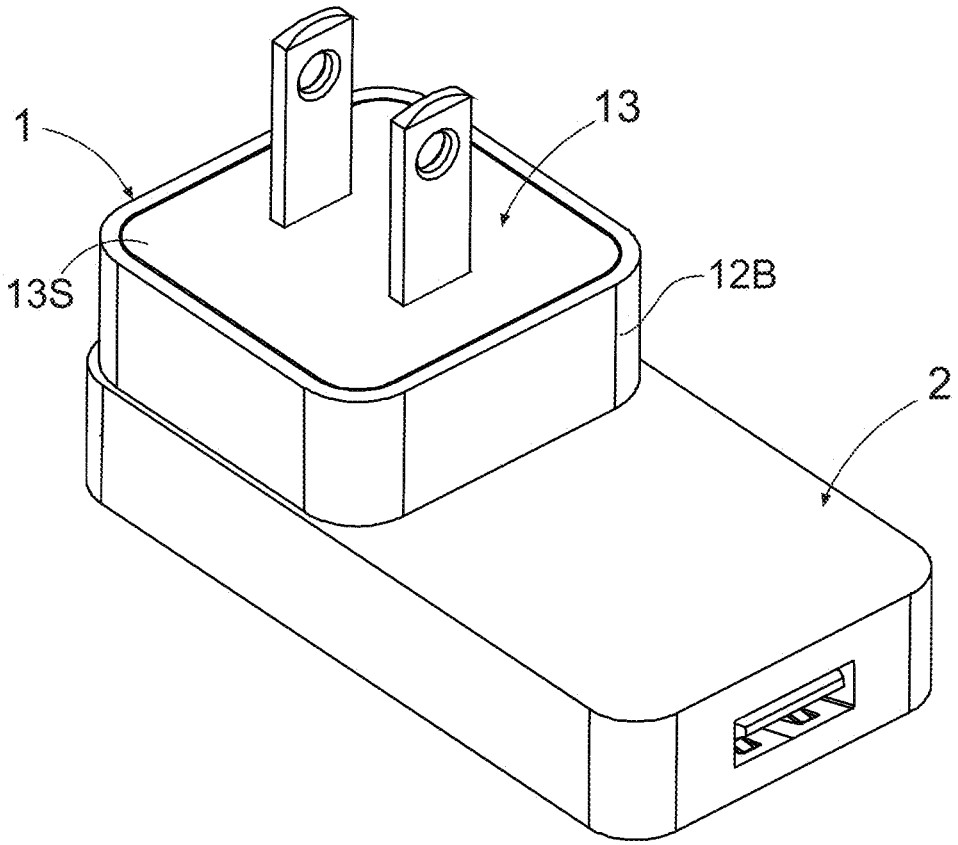
FIG. 1 shows a first stereo diagram of a power device and a rotatable power plug assembly according to the present invention.
Figure 2:
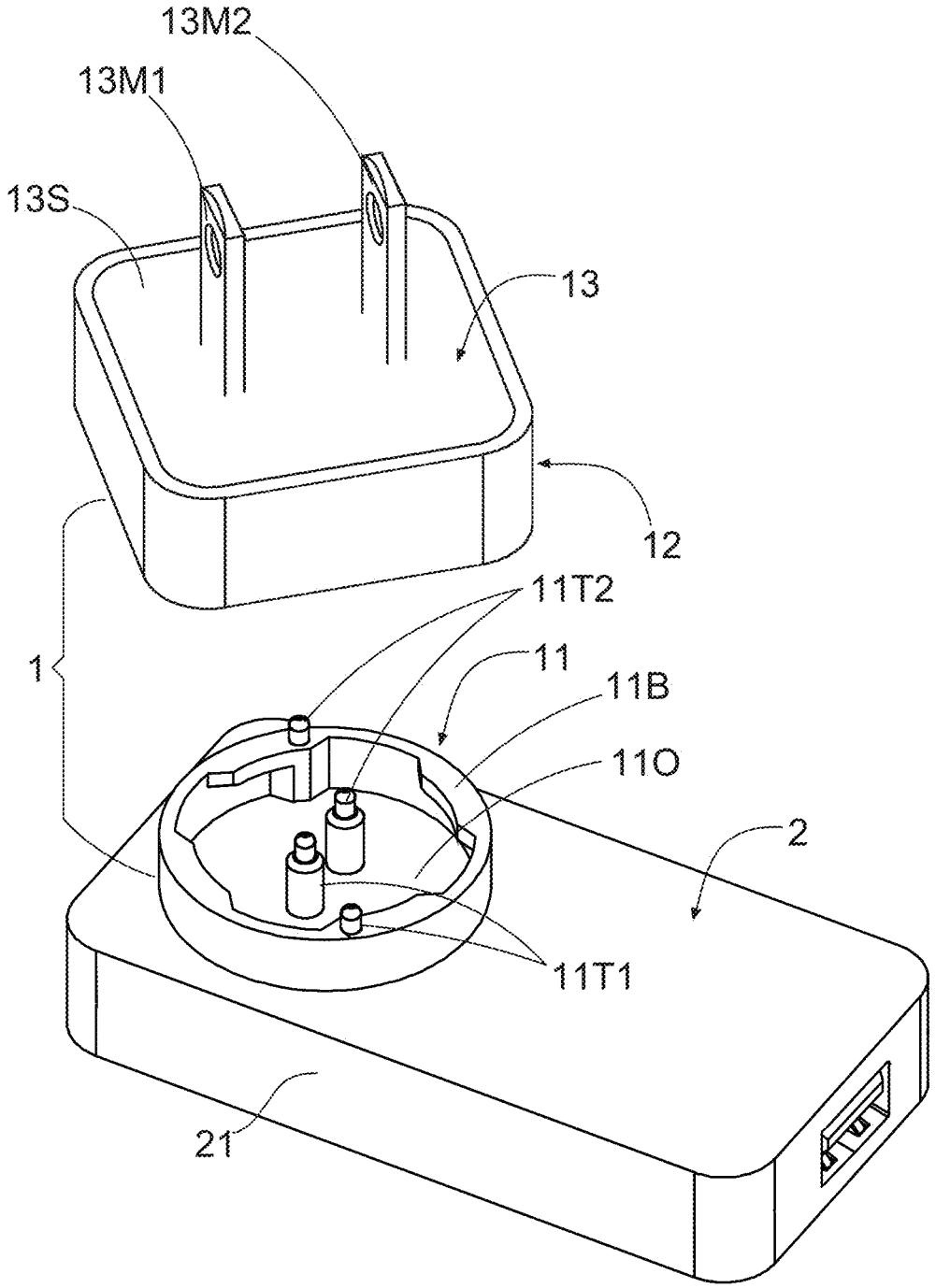
FIG. 2 shows a second stereo diagram of the power device and the rotatable power plug assembly according to the present invention.

With reference to FIG. 1, there is shown a first stereo diagram of a power device and a rotatable power plug assembly according to the present invention. Moreover, FIG. 2 illustrates a second stereo diagram of the power device and the rotatable power plug assembly according to the present invention. The present invention discloses a rotatable power plug assembly 1 for being applied in a power device 2, such as charging device, power conversion device, power adapter, power extension device, or power bank. Please simultaneously refer to FIG. 3 that shows a first exploded view of the rotatable power plug assembly 1. According to the present invention, the rotatable power plug assembly 1 principally comprises a first connection module 11, a second connection module 12 and a plug module 13.

Figure 3:
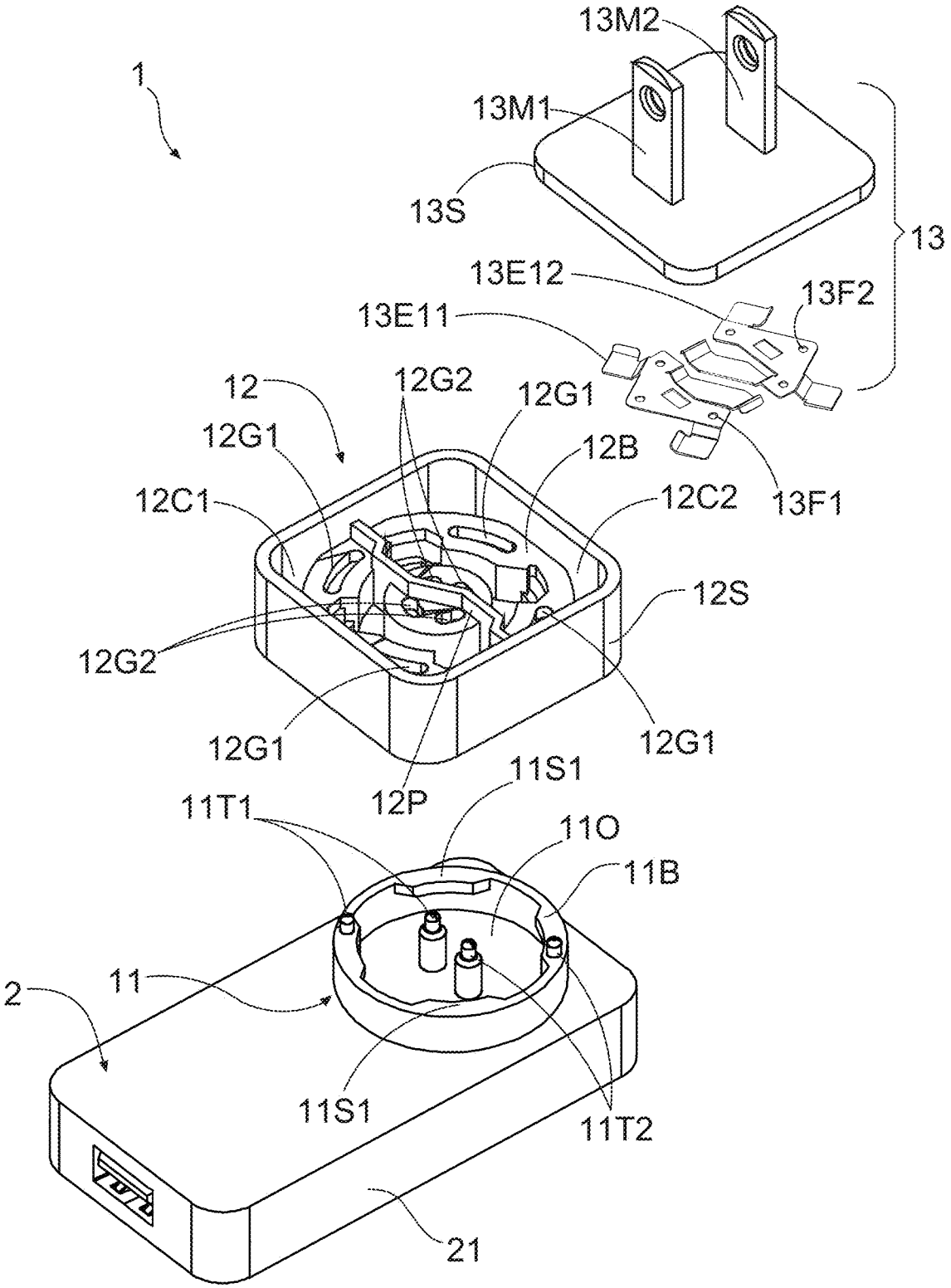
FIG. 3 shows a first exploded view of the rotatable power plug assembly according to the present invention.

As described in more detail below, the first connection module 11 is disposed on (or connected to) a housing 21 of the power device 2, and comprises a first base 11B that is provided with two first conductive pins 11T1 and two second conductive pins 11T2 thereon. As FIG. 2 and FIG. 3 show, the second connection module 12 is stacked on the first connection module 11, and comprises a hollow accommodating member 12S that accommodates a second base 12B therein. Moreover, the second base 12B is provided with four first arc-shaped guide grooves 12G1 and four second arc-shaped guide grooves 12G2 thereon, such that one of the two first conductive pins 11T1 and one of the two second conductive pins 11T2 are respectively disposed in two of the four first arc-shaped guide grooves 12G1, and the other one first conductive pin 11T1 and the other one second conductive pin 11T2 are respectively disposed in two of the four second arc-shaped guide grooves 12G2.

Figure 4:
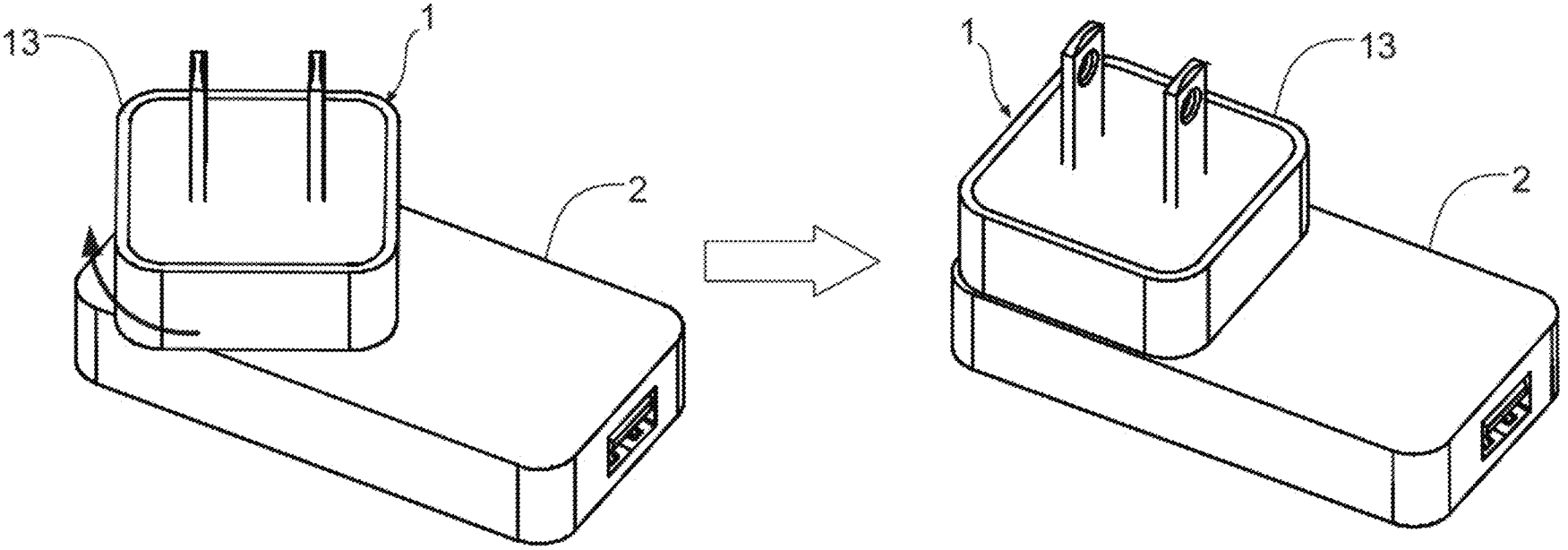
FIG. 4 shows a diagram for describing a flow diagram to explain two action states of the rotatable power plug assembly in practical use.
Figure 5:
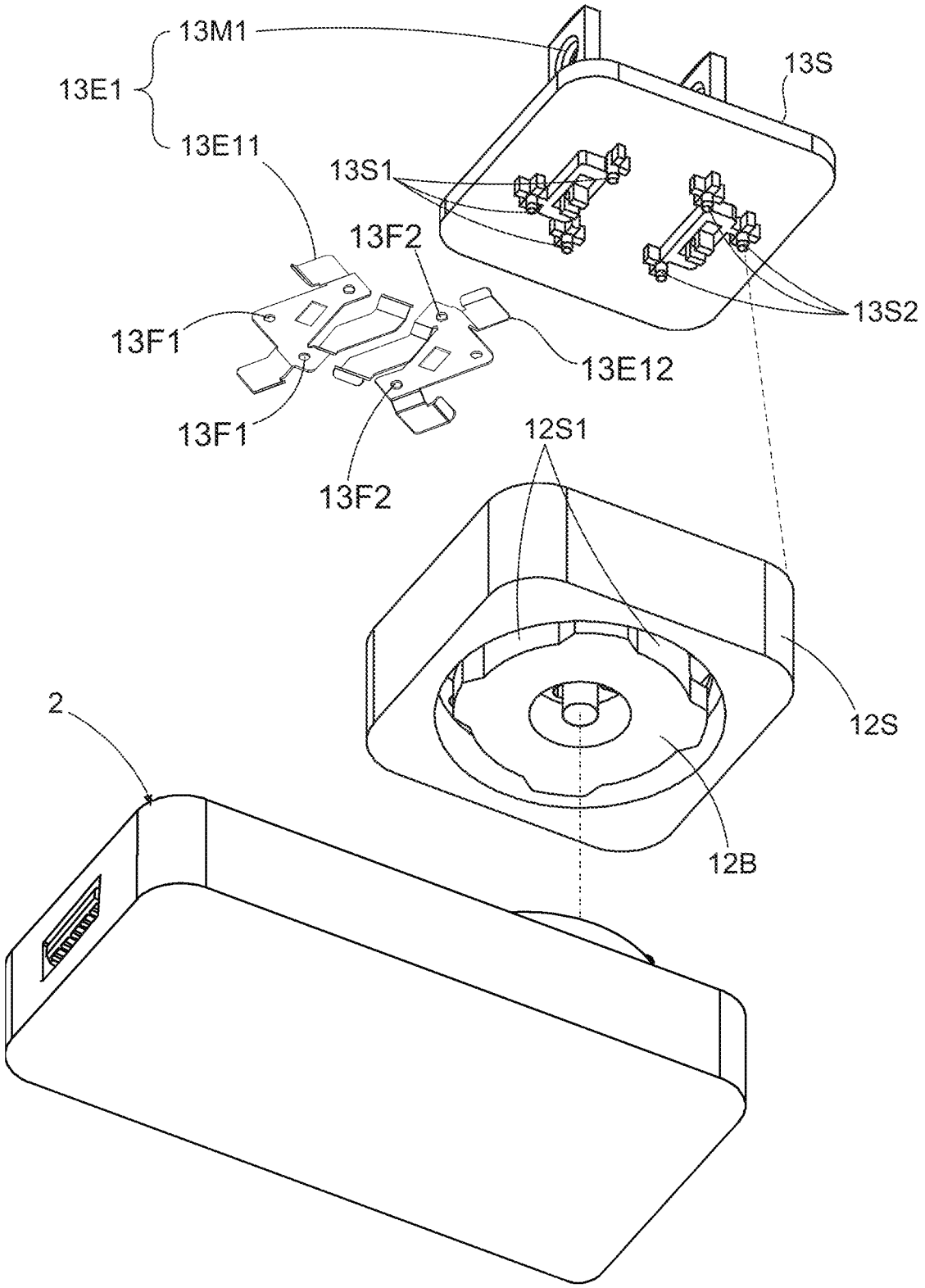
FIG. 5 shows a second exploded view of the rotatable power plug assembly according to the present invention.

FIG. 4 shows a diagram for describing a flow diagram to explain two action states of the rotatable power plug assembly 1 in practical use, and FIG. 5 provides a second exploded view of the rotatable power plug assembly 1. According to the present invention, the plug module 13 is stacked on the second connection module 12, and comprises: a substrate 13S, a first fixing member having at least one first fixing protrusion 13S1, and a second fixing member having at least one second fixing protrusion 13S2, a first electrical unit 13E1, and a second electrical unit 13E2. As FIG. 4 and FIG. 5 shows, the first electrical unit 13E11 comprises a first electrical member 13E11 that is disposed on a bottom surface of the substrate 13S and a first prong 13M1 that is connected to the first electrical member 13E11 by a base end thereof. Moreover, the first electrical member 13E11 is provided with two first contact points thereon, and an electrical end of the first electrical member 13E11 is protruded out of a top surface of the substrate 13S. The second electrical unit 13E2 comprises a second electrical member 13E12 that is disposed on the bottom surface of the substrate 13S and a second prong 13M2 that is connected to the second electrical member 13E12 by a base end thereof, wherein the second electrical member 13E12 is also provided with two second contact points thereon, and an electrical end of the second electrical member 13E12 is protruded out of the top surface of the substrate 13S.

Figure 6:
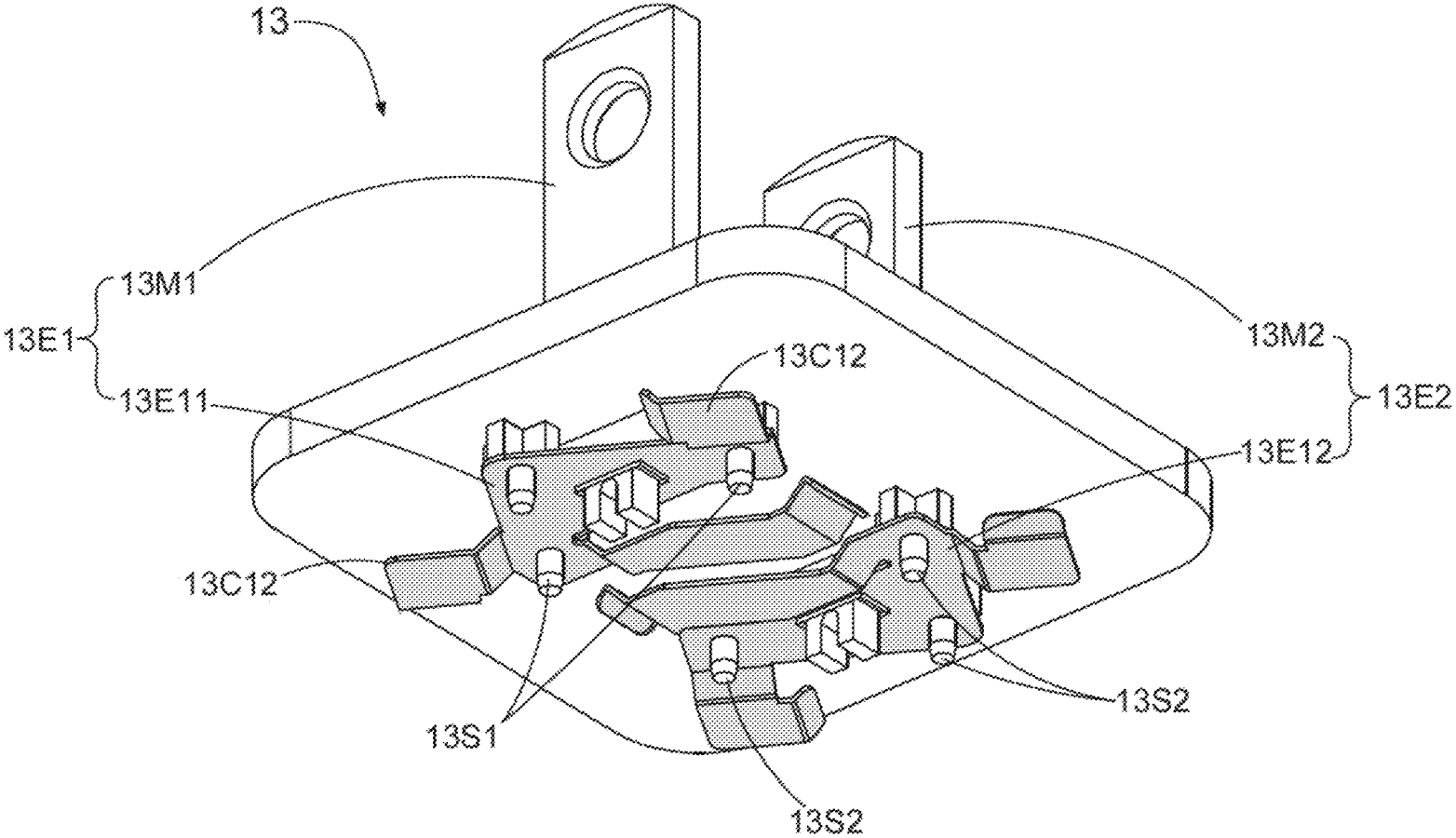
FIG. 6 shows a stereo diagram of a plug module of the rotatable power plug assembly.
Figure 7:
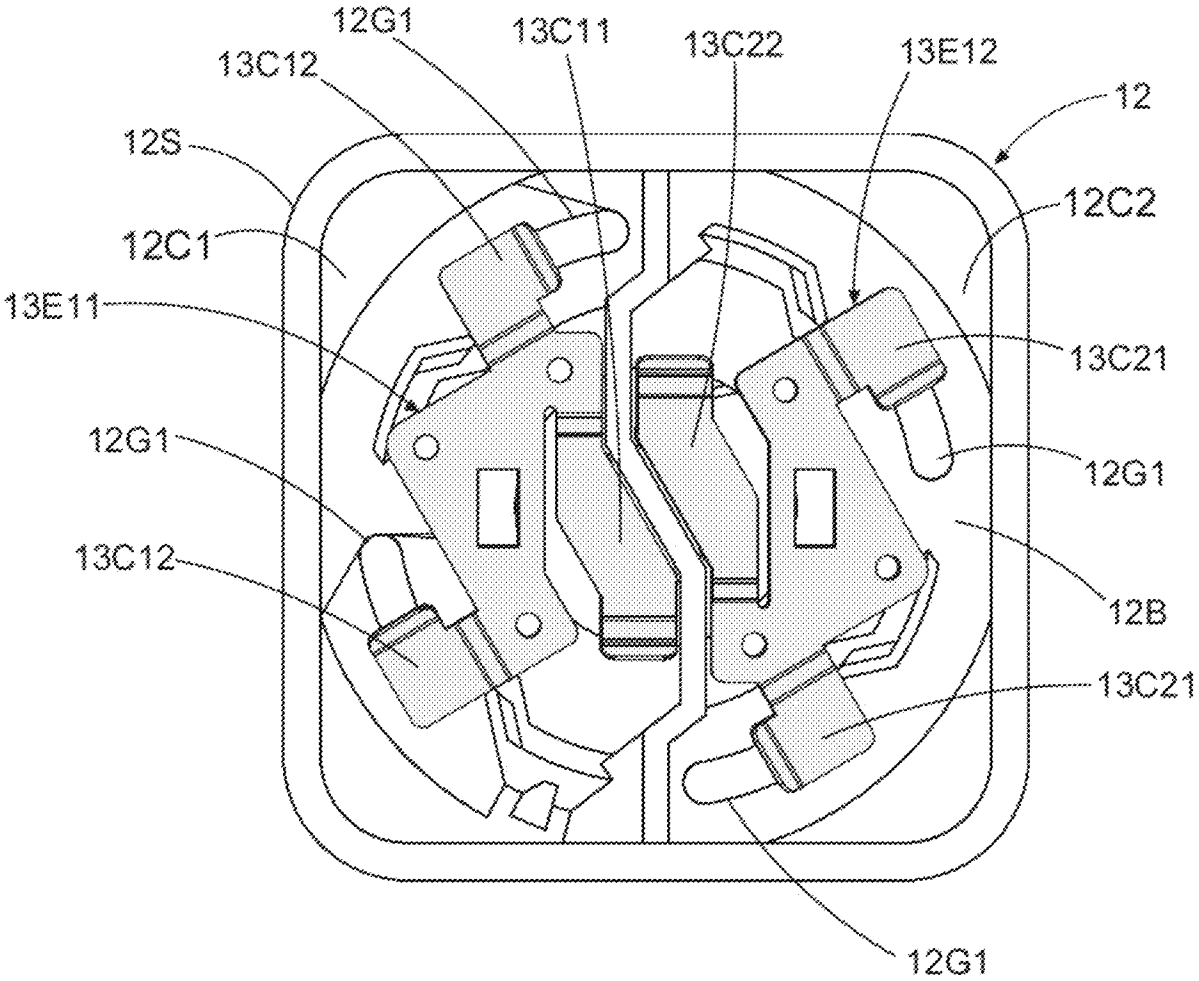
FIG. 7 shows a top view of a first electrical unit, a second electrical unit and a second connection module of the rotatable power plug assembly.

FIG. 6 shows a stereo diagram of the plug module 12, and FIG. 7 provides a top view of the first electrical unit 13E1, the second electrical unit 13E2 and the second connection module 12. From FIG. 5, FIG. 6 and FIG. 7, it is observed that and the first electrical member 13E11 and the second electrical member 13E12 are further provided with at least one first fixing holes 13F1 and at least one second fixing holes 13F2, such that the first fixing protrusion 13S1 and the second fixing protrusion 13S2 are respectively embedded into the first fixing holes 13F1 and the second fixing holes 13F2 after the first electrical member 13E11 and the second electrical member 13E12 are connected to the bottom surface of the substrate 13S. By such arrangement, in case of the second connection module 12 being rotated to have a rotation angle that is equal to a pre-determined angle, one of the two first conductive pins 11T1 contacts with one of the two first contact points of the first electrical member 13E11, and one of the two second conductive pins 11T2 contacts with one of the two second contact points of the second electrical member 13E12. On the other hand, in case of the second connection module being rotated to have the rotation angle that is equal to zero degree, the two first conductive pins 11T1 contact with the two first contact points of the first electrical member 13E11, and the two second conductive pins 11T2 contact with the two second contact points of the second electrical member 13E12.

It is understood that, the first prong 13M1 and the second prong 13M2 of the plug module 13 are two flat parallel prongs, such that the first prong 13M1 and the second prong 13M2 are allowed to be respectively inserted into two receptacle openings of a type A plug socket. Therefore, electricity receiving from the plug socket is firstly transmitted from the two prongs (13M1, 13M2) to the two electrical members (13E11, 13E12), and is subsequently transmitted from the two electrical members (13E11, 13E12) to at least one of the two first conductive pins 11T1 and at least one of the two second conductive pins 11T2. In a practicable embodiment, the forgoing power device 2 can be a charging device, a power conversion device, a power adapter, a power extension device, or a power bank. FIG. 1 also depicts that the power device 2 includes at least one electrical connecter, for example, a USB type-C connecter. Thus, it can be imagined that, there is a power conversion circuit provided in the housing 21 of the power device 2, and the power conversion circuit has a power input interface (or an electricity receiving interface) that is electrically connected to the two first conductive pins 11T1 and the two second conductive pins 11T2. As FIG. 3 and FIG. 4 show, the second connection module 12 further comprises a hollow accommodating member 12S that accommodates a second base 12B therein, and there is a partition member 12P disposed on the second base 12B, such that a first space 12C1 is formed between the hollow accommodating member 12S, the second base 12B and a left side of the partition member 12P, and a second space 12C2 is formed between the hollow accommodating member 12S, the second base 12B and a right side of the partition member 12P. As FIG. 3, FIG. 4, and FIG. 7 show, the first electrical member 13E11 is disposed in the first space 12C1, the second electrical member 13E12 is disposed in the first space 12C1, and the bottom surface of the substrate 13S of the plug module 13 being connected with a top side of the hollow accommodating member 12S by ultrasonic welding.

Figure 8:
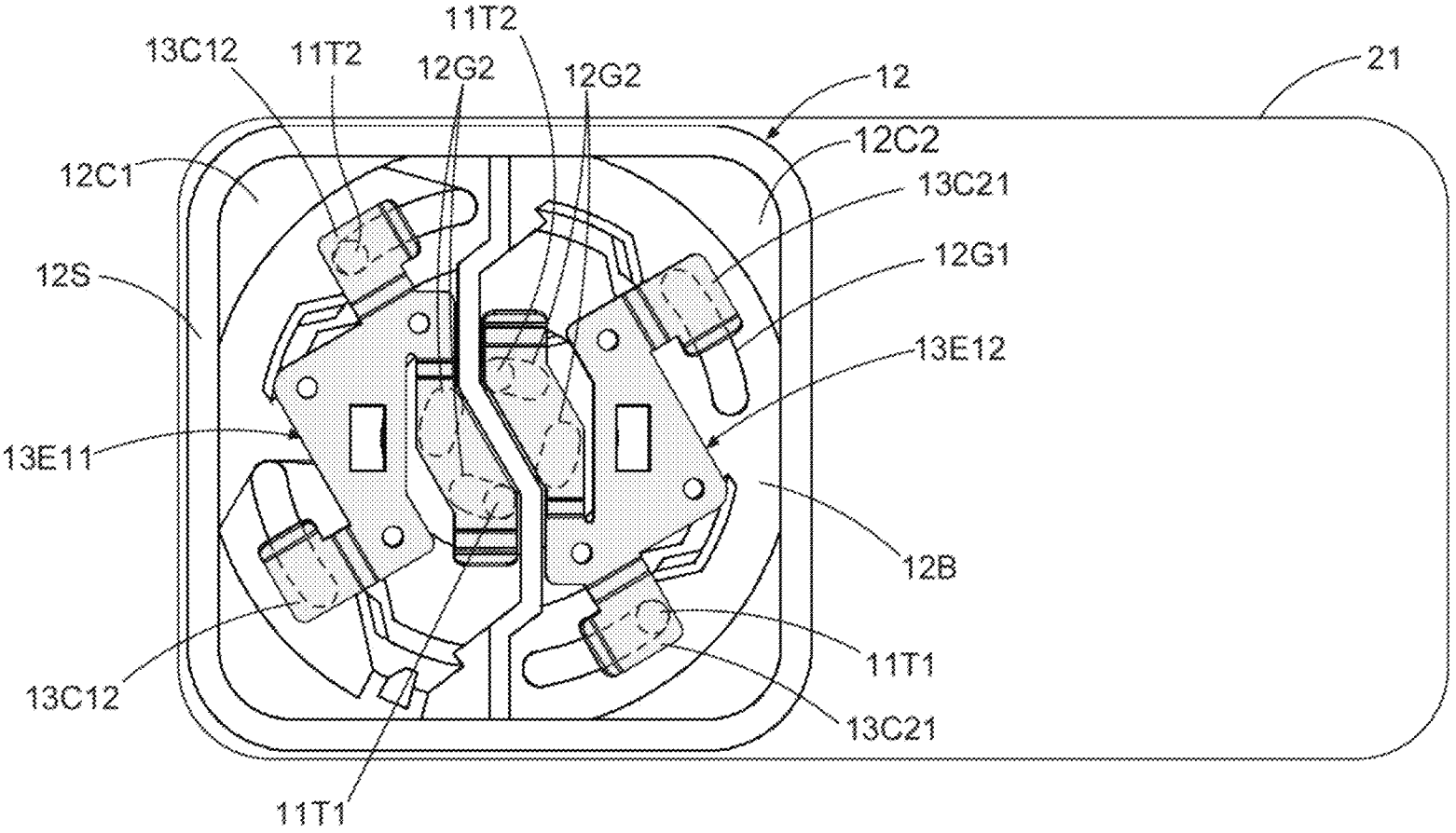
FIG. 8 shows a top view of the first electrical unit, the second electrical unit and the second connection module when the rotatable power plug assembly is operated in a normal state.
Figure 9:
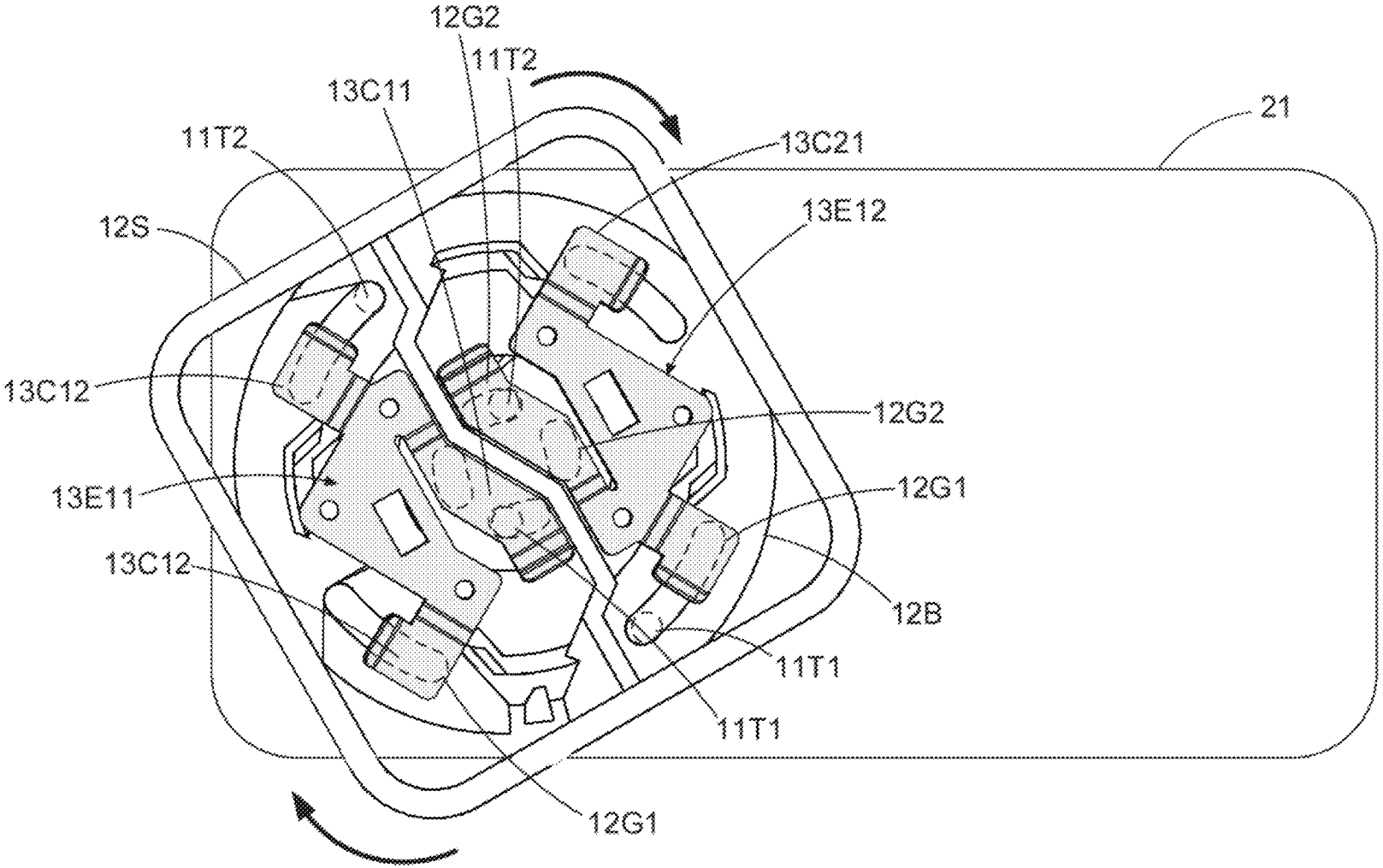
FIG. 9 shows a top view of the first electrical unit, the second electrical unit and the second connection module when the rotatable power plug assembly is operated in a rotation state.

FIG. 8 shows a top view of the first electrical unit 13E1, the second electrical unit 13E2 and the second connection module 12 when the rotatable power plug assembly 1 is operated in a normal state. FIG. 9 shows a top view of the first electrical unit 13E1, the second electrical unit 13E2 and the second connection module 12 when the rotatable power plug assembly 1 is operated in a rotation state. As described in more detail below, the first electrical member 13E11 is designed to have one first contact portion 13C11 and two second contact portions 13C12. As FIG. 3, FIG. 7 and FIG. 8 show, after the plus module 13 is stacked on the second connection module 12, the first contact portion 13C11 covers two of the four second arc-shaped guide grooves 12G2 of the second base 12B, and are used as one of the two first contact points of the first electrical member 13E11 for contacting with one of the two first conductive pins 11T1. Moreover, the two second contact portions 13C12 partially cover two of the four first arc-shaped guide grooves 12G1 of the second base 12B, wherein one of the two second contact portions 13C12 is used as the other one first contact point of the first electrical member 13E11 for contacting with the other one first conductive pin 11T1. Opposite to the first electrical member 13E11, moreover, the second electrical member 13E12 comprises one third contact portion 13C22 and two fourth contact portions 13C21. After the plug module 13 is stacked on the second connection module 12, the third contact portion 13C22 covers the other two second arc-shaped guide grooves 12G2 of the second base 12B, and is used as one of the two second contact points of the second electrical member 13E12 for contacting with one of the two second conductive pins 11T2. Moreover, the two fourth contact portions 13C21 partially cover the other two first arc-shaped guide grooves 12G1 of the second base 12B, wherein one of the two fourth contact portions 13C21 is used as the other one second contact point of the second electrical member 13E12 for contacting with the other one second conductive pin 11T2.

As FIG. 3, FIG. 4, FIG. 5, FIG. 7, FIG. 8 show, when the rotatable power plug assembly is operated in a normal state, the rotation angle of the second connection module 12 is equal to zero degree, in such case the two first conductive pins 11T1 respectively contact the first contact portion 13C11 (i.e., the above-described one of the two first contact points of the first electrical member 13E11) and one of the two second contact portions 13C12 (i.e., the above-described other one first contact point of the first electrical member 13E11), and the two second conductive pins 11T2 respectively contact the third contact portion 13C22 (i.e., the above-described one of the two second contact points of the second electrical member 13E12) and one of the two fourth contact portions 13C21 (i.e., the above-described the other one second contact point of the second electrical member 13E12). On the other hand, as FIG. 3, FIG. 4, FIG. 5, FIG. 7, FIG. 9 show, when the rotatable power plug assembly is operated in a rotation state, the rotation angle of the second connection module 12 is equal to the pre-determined angle, in such case one of the two first conductive pins 11T1 contact with the first contact portion 13C11 (i.e., one first contact point) of the first electrical member 13E11, and one of the two second conductive pins 11T2 contact with the third contact portion 13C22 (i.e., one second contact point) of the second electrical member 13E12.

From FIG. 3 and FIG. 7, it is also observed that an arc length of the first arc-shaped guide groove 12G1 is greater than that of the second arc-shaped guide groove 12G2. For the four first arc-shaped guide grooves 12G1, two of them are located in the first space 12C1, and the other two are located in the second space 12C2, and have mirror symmetrical relationship with the forgoing two located in the first space 12C1. Similarly, for the four second arc-shaped guide grooves 12G2, two of them are located in the first space 12C1, and the other two are located in the second space 12C2, and have mirror symmetrical relationship with the forgoing two located in the first space 12C1.

In a practicable embodiment, the rotation angle can be 30, 45, 60, 75, 90, 210 (=30+180), 225(=45+180), 240 (=60+180), 255 (=75+180), or 270 (=90+180) by correspondingly designing the arc length of the first arc-shaped guide grooves 12G1, the arc length of the second arc-shaped guide grooves 12G2, the position of the first contact portion 13C11 on the first electrical member 13E11, the position of the second contact portion 13C12 on the first electrical member 13E11, the position of the third contact portion 13C22 on the second electrical member 13E12, the position of the fourth contact portion 13C21 on the second electrical member 13E12. Briefly speaking, the rotatable power plug assembly 1 according to the present invention has multiple advantages, including: comprising elements and units can be simply assembled, modular design, high durability, and high security.

Moreover, in one practicable embodiment, the first prong 13M1 and the second prong 13M2 can also be two cylindrical parallel prongs, such that the first prong 13M1 and the second prong 13M2 are allowed to be respectively inserted into two receptacle openings of a type C plug socket. Furthermore, the plug module 13 can also be designed to include the first prong 13M1, the second prong 13M2, and a third prong disposed on the substrate 13S, such that the first prong 13M1, the second prong 13M2 and the third prong are respectively used as a live prong, a neutral prong and a ground prong, thereby being allowed to be respectively inserted into three receptacle openings of a type B plug socket. On the other hand, the plug module 13 includes the first prong 13M1, the second prong 13M2 and third prong can be particularly designed, such that the first prong 13M1, the second prong 13M2 and the third prong are three cylindrical prongs, thereby being allowed to be respectively inserted into three receptacle openings of a type D plug socket. Moreover, the plug module 13 includes the first prong 13M1, the second prong 13M2 and third prong can be particularly designed, such that the first prong 13M1, the second prong 13M2 and the third prong are three cylindrical prongs, thereby being allowed to be respectively inserted into three receptacle openings of a type E plug socket.

It needs to further explain that, as FIG. 3 and FIG. 5 show, there are a plurality of recesses 12S1 formed around sides of a second base 12B, and there are a plurality of protrusions 1151 formed around sides of a top of the first body 11B, such that the plurality of protrusions 11S1 are respectively engaged with the plurality of recesses 12S1 after the second connection module 12 is rotated to have the rotation angle equal to zero degree.

Therefore, through above descriptions, all embodiments and their constituting elements of the rotatable power plug assembly proposed by the present invention have been introduced completely and clearly; in summary, the present invention includes the advantages of:

(1) The present invention discloses a rotatable power plug assembly 1 for use in a power (supply) device 2. The rotatable power plug assembly 1 principally comprises: a first connection module 11, a second connection module 12 and a plug module 13, wherein the second connection module 12 is connected between the first connection module 11 and the plug module 13. According to the present invention, the first connection module 11 comprises a first base 11B that is disposed on a housing 21 of the power device 2, and there are two first conductive pins 11T1 and two second conductive pins 11T2 provided on the first base 11. Moreover, the plug module 13 comprises two prongs (13M1, 13M2) and two electrical members (13E11, 13E12) electrically connected to the prongs. The two electrical members (13E11, 13E12) contact with the first conductive pins 11T1 and two second conductive pins 11T2 through the second connection module 12. By such arrangement, the rotatable power plug assembly 1 according to the present invention has multiple advantages, including: comprising elements and units can be simply assembled, modular design, high durability, and high security.

The above description is made on embodiments of the present invention. However, the embodiments are not intended to limit scope of the present invention, and all equivalent implementations or alterations within the spirit of the present invention still fall within the scope of the present invention.

What is claimed is:

1. A rotatable power plug assembly, being applied in a power device, and comprising:

a first connection module, being disposed on a housing of the power device, and comprising a first base that is provided with two first conductive pins and two second conductive pins thereon;

a second connection module, being stacked on the first connection module, and comprising a second base that is provided with four first arc-shaped guide grooves and four second arc-shaped guide grooves thereon, such that one of the two first conductive pins and one of the two second conductive pins are respectively disposed in two of the four first arc-shaped guide grooves, and the other one first conductive pin and the other one second conductive pin being respectively disposed in two of the four second arc-shaped guide grooves; and a plug module, being stacked on the second connection module, and comprising:

a substrate;

a first electrical unit, comprising a first electrical member that is disposed on a bottom surface of the substrate and a first prong that is connected to the first electrical member by a base end thereof, wherein the first electrical member is provided with two first contact points thereon, and an electrical end of the first electrical member being protruded out of a top surface of the substrate; and a second electrical unit, comprising a second electrical member that is disposed on the bottom surface of the substrate and a second prong that is connected to the second electrical member by a base end thereof, wherein the second electrical member is also provided with two second contact points thereon, and an electrical end of the second electrical member being protruded out of the top surface of the substrate;

wherein in case of the second connection module being rotated to have a rotation angle that is equal to a pre-determined angle, one of the two first conductive pins contacting with one of the two first contact points of the first electrical member, and one of the two second conductive pins contacting with one of the two second contact points of the second electrical member;

wherein in case of the second connection module being rotated to have the rotation angle that is equal to zero degree, the two first conductive pins contacting with the two first contact points of the first electrical member, and the two second conductive pins contacting with the two second contact points of the second electrical member.

2. The rotatable power plug assembly of claim 1, wherein the power device is selected from a group consisting of charging device, power conversion device, power adapter, power extension device, and power bank.

3. The rotatable power plug assembly of claim 1, wherein the first prong and the second prong are two flat parallel prongs, such that the first prong and the second prong are allowed to be respectively inserted into two receptacle openings of a type A plug socket.

4. The rotatable power plug assembly of claim 1, wherein the first prong and the second prong are two cylindrical parallel prongs, such that the first prong and the second prong are allowed to be respectively inserted into two receptacle openings of a type C plug socket.

5. The rotatable power plug assembly of claim 1, wherein the plug module further comprises a third prong disposed on the substrate, such that the first prong, the second prong and the third prong are respectively used as a live prong, a neutral prong and a ground prong, thereby being allowed to be respectively inserted into three receptacle openings of a type B plug socket.

6. The rotatable power plug assembly of claim 1, wherein the plug module further comprises a third prong disposed on the substrate, such that the first prong, the second prong and the third prong are three cylindrical prongs, thereby being allowed to be respectively inserted into three receptacle openings of a type D plug socket.

7. The rotatable power plug assembly of claim 1, wherein the plug module further comprises a third prong disposed on the substrate, such that the first prong, the second prong and the third prong are three cylindrical prongs, thereby being allowed to be respectively inserted into three receptacle openings of a type E plug socket.

8. The rotatable power plug assembly of claim 1, wherein there are a plurality of recesses formed around sides of the second body, and there being a plurality of protrusions formed around sides of a top of the first body, such that the plurality of protrusions are respectively engaged with the plurality of recesses after the second connection module is rotated to have the rotation angle equal to zero degree.

9. The rotatable power plug assembly of claim 1, wherein there are a first fixing member having at least one first fixing protrusion and a second fixing member having at least one second fixing protrusion disposed on the bottom surface of the substrate, and the first electrical member and the second electrical member are further provided with at least one first fixing holes and at least one second fixing holes, such that the first fixing protrusion and the second fixing protrusion are respectively embedded into the first fixing holes and the second fixing holes after the first electrical member and the second electrical member are connected to the bottom surface of the substrate.

10. The rotatable power plug assembly of claim 1, wherein the second connection module further comprises a hollow accommodating member that accommodates the second base therein, and there being a partition member disposed on the second base, such that a first space is formed between the hollow accommodating member, the second base and a left side of the partition member, and a second space being formed between the hollow accommodating member, the second base and a right side of the partition member.

11. The rotatable power plug assembly of claim 10, wherein the first electrical member is disposed in the first space, the second electrical member being disposed in the first space, and the bottom surface of the substrate of the plug module being connected with a top side of the hollow accommodating member by ultrasonic welding.

12. The rotatable power plug assembly of claim 10, wherein the first electrical member comprises:

one first contact portion, covering two of the four second arc-shaped guide grooves of the second base, and being used as one of the two first contact points of the first electrical member for contacting with one of the two first conductive pins;

two second contact portions, partially covering two of the four first arc-shaped guide grooves of the second base, wherein one of the two second contact portions is used as the other one first contact point of the first electrical member for contacting with the other one first conductive pin.

13. The rotatable power plug assembly of claim 12, wherein the second electrical member comprises:

one third contact portion, covering the other two second arc-shaped guide grooves of the second base, and being used as one of the two second contact points of the second electrical member for contacting with one of the two second conductive pins;

two fourth contact portions, partially covering the other two first arc-shaped guide grooves of the second base, wherein one of the two fourth contact portions is used as the other one second contact point of the second electrical member for contacting with the other one second conductive pin;

wherein in case of the rotation angle of the second connection module being equal to the pre-determined angle, one of the two first conductive pins contacting with the first contact portion of the first electrical member, and one of the two second conductive pins contacting with the third contact portion of the second electrical member;

wherein in case of the rotation angle of the second connection module being equal to zero degree, the two first conductive pins respectively contacting the first contact portion and one of the two second contact portions, and the two second conductive pins respectively contacting the third contact portion and one of the two fourth contact portions.

14. The rotatable power plug assembly of claim 1, wherein the rotatable power plug assembly in applied in a power device that is used for supplying power to an electronic device.

15. The rotatable power plug assembly of claim 14, wherein the power device is selected from a group consisting of charging device, power conversion device, power adapter, power extension device, and power bank.

* * * * *